US009490086B2

(12) United States Patent
Lagree et al.

(10) Patent No.: US 9,490,086 B2
(45) Date of Patent: Nov. 8, 2016

(54) MOLDED CASE CIRCUIT BREAKER ACCESSORY WIRING IMPROVEMENT

(71) Applicant: EATON CORPORATION, Cleveland, OH (US)

(72) Inventors: James Leo Lagree, Robinson Township, PA (US); Bruce Richard Terhorst, Burgettstown, PA (US)

(73) Assignee: EATON CORPORATION, Cleveland, OH (US)

( * ) Notice: Subject to any disclaimer, the term of this patent is extended or adjusted under 35 U.S.C. 154(b) by 34 days.

(21) Appl. No.: 14/580,515

(22) Filed: Dec. 23, 2014

(65) Prior Publication Data

US 2016/0181026 A1 Jun. 23, 2016

(51) Int. Cl.

| | |
|---|---|
| ***H01H 9/54*** | (2006.01) |
| ***H01H 45/02*** | (2006.01) |
| ***H01H 1/06*** | (2006.01) |
| ***H01R 13/502*** | (2006.01) |
| ***H01H 71/08*** | (2006.01) |

(52) U.S. Cl.

CPC ..... *H01H 9/54* (2013.01); *H01H 1/06* (2013.01); *H01H 45/02* (2013.01); *H01H 71/08* (2013.01); *H01R 13/502* (2013.01); *H01H 2071/086* (2013.01); *H01H 2223/00* (2013.01)

(58) Field of Classification Search

CPC ..... H01R 31/065; H01R 13/7038; H01R 13/502; H01H 1/06; H01H 9/54

USPC ..... 439/814, 638

See application file for complete search history.

(56) References Cited

U.S. PATENT DOCUMENTS 5,606,299 A * 2/1997 Innes ..... H01H 50/021 335/132
6,329,810 B1 * 12/2001 Reid ..... G01R 22/065 324/117 H
7,116,538 B2 * 10/2006 Haensgen ..... H01H 71/0228 361/187
7,612,972 B2 * 11/2009 Battani ..... H01H 50/021 361/42
7,767,905 B2 * 8/2010 Meyer ..... H02G 3/086 174/135
2002/0076987 A1 * 6/2002 Reid ..... H01R 31/065 439/638
2004/0217831 A1 * 11/2004 Bauer ..... H01H 11/0031 335/202
2009/0325423 A1 * 12/2009 Bollinger ..... H01H 50/021 439/638
2014/0273618 A1 * 9/2014 King ..... H01R 43/20 439/535

FOREIGN PATENT DOCUMENTS

| | | |
|---|---|---|
| EP | 0 133 152 A1 | 2/1985 |
| EP | 0 621 670 A1 | 10/1994 |
| EP | 0 788 129 A2 | 8/1997 |
| FR | 2 796 768 A1 | 1/2001 |
| JP | H06 131965 A | 5/1994 |

OTHER PUBLICATIONS

European Patent Office, "International Search Report and Written Opinion", corresponding PCT application PCT/US2015/063090, Mar. 1, 2016, 11 pp.

* cited by examiner

*Primary Examiner* — Briggitte R Hammond
(74) *Attorney, Agent, or Firm* — Eckert Seamans; Carol Marmo; Grant Coffield

(57) ABSTRACT

The disclosed concept relates to electrical switching apparatus, such as, but not limited to, molded case circuit breakers, and more particularly, to a connector assembly for mechanically and electrically connecting the accessory components housed within the electrical switching apparatus to equipment located outside of the electrical switching apparatus.

12 Claims, 5 Drawing Sheets

MOLDED CASE CIRCUIT BREAKER ACCESSORY WIRING IMPROVEMENT

BACKGROUND

1. Field

The disclosed concept relates generally to electrical switching apparatus and, more particularly, circuit interrupters, such as circuit breakers. The disclosed concept also relates to electrical switching apparatus accessory components, such as, for example, shunt trip and under voltage release devices.

2. Background Information

Electrical switching apparatus are often equipped with accessory components such as, for example and without limitation, shunt trip devices and under voltage release (UVR) devices. Such devices can be employed in a variety of ways to initiate a change in status of the apparatus such as, for example, to trip open separable contacts of the apparatus in response to an electrical fault condition (e.g., without limitation, current overload, short circuit or abnormal voltage) or other external condition.

Electrical switching apparatus include, for example, circuit switching devices, circuit interrupters, such as circuit breakers, network protectors, contactors, motor starters, motor controllers, and other load controllers. Electrical switching apparatus such as circuit interrupters and, in particular, circuit breakers of the molded case variety, are well known in the art. Circuit breakers are used to protect electrical circuitry from damage due to an over-current condition, such as an overload condition or a relatively high level short circuit or fault condition. Molded case circuit breakers typically include a pair of separable contacts per phase. The separable contacts may be operated either manually by way of a handle disposed on the outside of the case, or housing assembly, or automatically in response to an over-current condition.

Some molded case circuit breakers, for example, employ a molded housing having two parts, a first half or front part (e.g., a molded cover), and a second half or rear part (e.g., a molded base). The molded case is, in many instances, generally divided into channel-like internal cavities with a conductor assembly for each pole extending through each cavity. The cavities further provide a space for additional components, e.g., accessory components. When added to molded case circuit breakers, accessory components are typically placed into pockets and any connection wires associated with the accessory components are routed through slots positioned on either side or both sides of the molded case circuit breakers. For electronic trip units in molded case circuit breakers, there can also be additional wires, such as, neutral sensor wires, including ground fault alarm contacts, arc fault maintenance wires (which enable inputs and outputs), communications wires and zone selective interlock wires. The wires exiting the molded case circuit breakers through the slots are required to be rated for the maximum voltage level (i.e., 600 V) for any application or installation. As a result, the wires are generally thick and therefore the number of wires that can pass through each of the slots provided on the sides of the molded case circuit breakers is limited. Further, additional engineering of the connection wires to the accessory components may be provided in order to satisfy pull test requirements to assure that the wires cannot be pulled out of the breaker (e.g., by an operator or a customer) causing an unsafe condition. In addition, the connection wires are required to be equal in length to the longest length required for an application or installation. Thus, often times, the wires are longer than what is needed for wiring of the accessory components.

FIG. 1 shows an unassembled electrical switching apparatus such as, for example, an unassembled circuit breaker 2, in accordance with the prior art. The circuit breaker 2 includes a base 4. Typically, the housing of the circuit breaker 2 includes a front portion and a rear portion or base 4 which are connected together. In FIG. 1, only the base 4 is shown and, the front portion is removed from the housing and is not shown. The base 4 is open to show a cavity and positioned within the base 4 is an accessory component 8, which has a plurality of accessory wires 10 extending therefrom. As above-described there are typically various other components positioned within the base portion of a housing for an electrical switching apparatus, which are not shown in FIG. 1. In FIG. 1, three accessory wires are shown, however, it is contemplated that there may be more or less accessory wires depending on the number of accessory components and the number of wires associated with the particular accessory components. Multiple slots 12 are formed within a side wall 6 of the base 4. Each of the plurality of accessory wires 10 can pass through a corresponding one of the multiple slots 12. Although, one set of multiple slots 12 is shown in FIG. 1, it is contemplated that another set of multiple slots can be formed within the other side wall (not shown) of the base 4, opposite the side wall 6, adapted for a plurality of accessory wires from another accessory component (not shown).

It would be advantageous for a connector assembly to be installed within the electrical switching apparatus in order to mechanically and electrically connect the wires of an accessory component positioned in the housing to user equipment that is positioned outside of the housing. Thus, there is room for improvement in electrical switching apparatus, such as circuit breakers, and in connecting the accessory components for a molded case circuit breaker.

SUMMARY

These needs and others are met by embodiments of the disclosed concept, which are directed to accessory wiring and connectors for electrical switching apparatus, such as molded case circuit breakers.

As one aspect of the disclosed concept, a connector assembly is provided for an electrical switching apparatus. The electrical apparatus includes a housing having a front portion and a rear portion, the rear portion having a plurality of walls that form an inner cavity and an outer surface, and one or more accessory components enclosed by the housing. Each of the one or more accessory components includes at least one accessory connection wire having a first end and an opposite second end, the first end being coupled to the one or more accessory components. The connector assembly includes an elongated member having a first end and an opposite second end, and an elongated portion disposed there between. There are one or more connectors extending outwardly from a first surface of the elongated member and one or more apertures formed in a second surface of the elongated member opposite the first surface. The one or more connectors are adapted to engage the second end of the at least one accessory connection wire. The one or more apertures extend horizontally through the elongated member and align with the one or more connectors. The one or more apertures are adapted to receive one or more wires from user equipment. The connector assembly is operable to mechanically and electrically connect the at least one accessory connection wire with the one or more user equipment wires.

The elongated member can extend through one of said plurality of walls of the rear portion and be coupled to the rear portion.

The electrical switching apparatus can be a molded case circuit breaker.

The one or more accessory components can be selected from shunt trips, under-voltage releases, auxiliary contacts and bell alarm contacts.

In certain embodiments, the connector assembly further includes a plug-in mate. The plug-in mate can include an extension member having a first end and an opposite second end, and an extension portion disposed there between, one or more extension connectors extending outwardly from a first surface of the extension member and adapted to engage the corresponding one or more apertures of the elongated member of the connector assembly, and one or more extension apertures extending horizontally through the extension member and aligning with the one or more extension connectors. The one or more extension apertures adapted to receive the one or more wires from the user equipment.

The plug-in mate can be structured to connect to the elongated member of the connector assembly and the extension member of the plug-in mate extends outwardly perpendicular from one of the plurality of walls of the rear portion. Alternately, the plug-in mate can have a right-angle shape.

As another aspect of the disclosed concept, an electrical switching apparatus is provided. The electrical switching apparatus includes a housing having a front portion and a rear portion, the rear portion having a plurality of walls that form an internal cavity and an outer surface; one or more accessory components enclosed by the housing, each of the one or more accessory components including at least one connection wire having a first end and an opposite second end, the first end of the connection wire being coupled to the one or more accessory components; and at least one connector assembly being structured to extend into one of the plurality of walls of the rear portion. The connector assembly includes one or more connectors extending outwardly from a first surface of the elongated member and adapted to engage the second end of the at least one accessory connection wire; and one or more apertures extending horizontally through the elongated member and aligning with the one or more connectors, the one or more apertures adapted to receive one or more wires from user equipment. The connector assembly is operable to mechanically and electrically connect the at least one accessory connection wire with the one or more user equipment wires.

The connector assembly can extend into one of the plurality of walls. In certain embodiments, a first connector assembly and a second connector assembly can extend into one of the plurality of walls. In other embodiments, a first connector assembly can extend into one of the plurality of walls and a second connector assembly extends into a second, different one of the plurality of walls.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
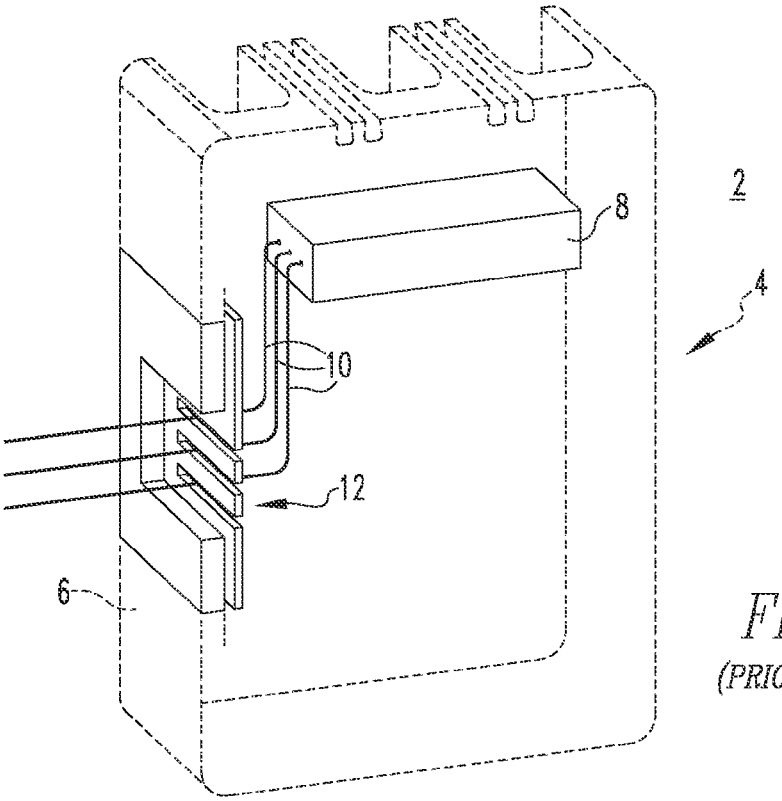
FIG.1 (PRIOR ART)
FIG. 1 is a schematic showing the back or rear portion of an unassembled molded case circuit breaker and slots for engaging accessory connection wires, in accordance with the prior art.

For purposes of illustration, embodiments of the disclosed concept will be shown and described as applied to low-voltage molded case circuit breakers, although it will become apparent that they also could be applied to a wide variety of electrical switching apparatus (e.g., without limitation, circuit switching devices and other circuit interrupters, such as contactors, motor starters, motor controllers and other load controllers) other than low-voltage molded case circuit breakers and other than low-voltage electrical switching apparatus.

Directional phrases used herein, such as, for example, left, right, clockwise, counterclockwise, top, bottom and derivatives thereof, relate to the orientation of the elements shown in the drawings and are not limiting upon the claims unless expressly recited therein.

As employed herein, the terms "connector" and "connector assembly" refer to any known or suitable component or assembly, respectively, that is structured to accept one or more wires, e.g., an end of each of the one or more wires, connected to one or more accessory components located in the molded case circuit breaker.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
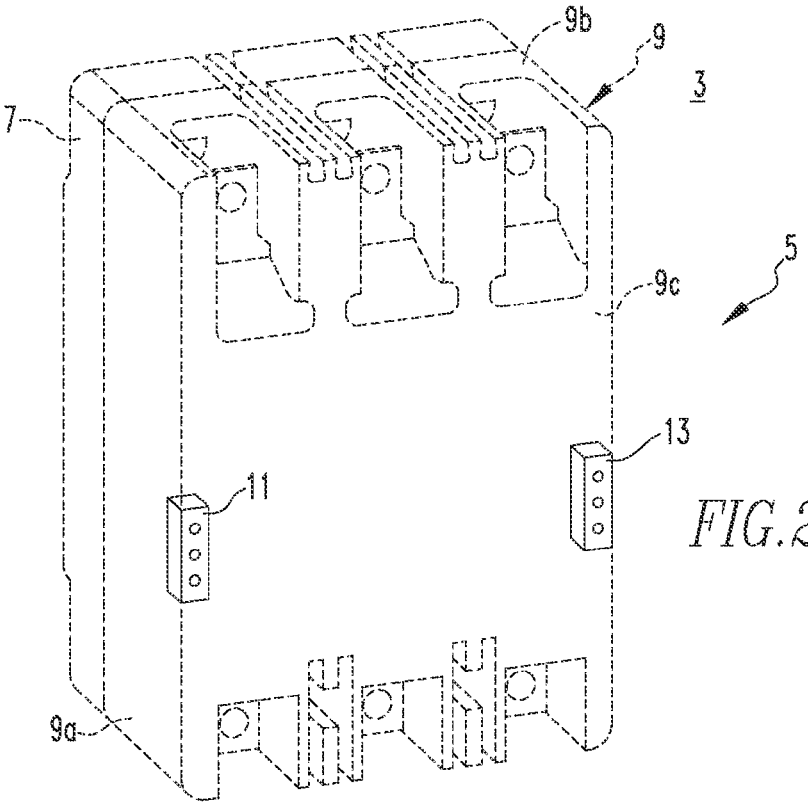
FIG. 2 is a schematic showing an assembled molded case circuit breaker and stationary connector assemblies, in accordance with certain embodiments of the disclosed concept.

FIG. 2 shows an assembled electrical switching apparatus such as, for example, an assembled low-voltage circuit breaker 3, in accordance with certain embodiments of the disclosed concept. The circuit breaker 3 includes a housing 5. The housing 5 is in the form of a rectangular member. However, the particular rectangular member is not meant to be limiting and it should be understood that other types of housing members, e.g., having various shapes and sizes, may be substituted for the housing 5. In general, the particular housing member selected can depend on the size and configuration of the circuit breaker, the switchgear and/or the other components positioned in the circuit breaker. The housing 5 can be constructed of a wide range of materials. Suitable materials include those materials that are known in the art for use in electrical switching assemblies. The housing 5 is typically made of a substantially rigid material, such as, but not limited to, molded plastic. The housing 5 includes a front portion 7, e.g., a molded cover, and a rear portion 9, e.g., a molded base. The front and rear portions 7,9 are coupled together. The rear portion 9 has an outer side wall 9*a*, another side wall (not shown) positioned opposite side wall 9*a*, a top wall 9*b*, a bottom wall (not shown) positioned opposite the top wall 9*b*, and a back wall 9*c*. A first stationary connector assembly 11 is positioned in the rear portion 9 and extends through the back wall 9*c*. A second stationary connector assembly 13 is positioned opposite the first stationary connector assembly 11 in the rear portion 9 and extends through the back wall 9*c*. An external surface of each of the first and second stationary connector assemblies 11,13 is generally flush with the surface of the back wall 9*c*. One or more openings 14,15 (shown in FIG. 2B) may be formed in the outer back wall 9*c* of the rear portion 9. Each of the openings 14,15 being adapted to receive each of the corresponding first and second stationary connector assemblies 11,13 therein. Although FIG. 2 shows both the first and second stationary connector assemblies 11,13, it is contemplated that in certain embodiments, the low-voltage circuit breaker 3 includes only one of the two connector assemblies, e.g., only the first stationary connector assembly 11 or the second stationary connector assembly 13. Furthermore, although FIG. 2 shows the first and the second stationary connector assemblies 11,13 positioned in the back wall 9*c*, it is contemplated that one or both of the first and second stationary connector assemblies 11,13 may be positioned in the side wall 9*a* (as shown in FIG. 2A).

The first and second stationary connector assemblies 11,13 can be mounted to the rear portion 9 of the housing 5 using various fastening mechanisms (not shown) that are known in the art for coupling or connecting one surface or substrate to another surface or substrate. The first and second stationary connector assemblies 11,13 can be constructed of a wide range of materials. Suitable materials include those materials that are known in the art for use in electrical switching assemblies. For example, the first and second stationary connector assemblies 11,13 can be made of a substantially rigid material, such as, but not limited to, molded plastic, or each can be made of a less rigid and more flexible material, such as, an elastomeric material.

Figure 2A:
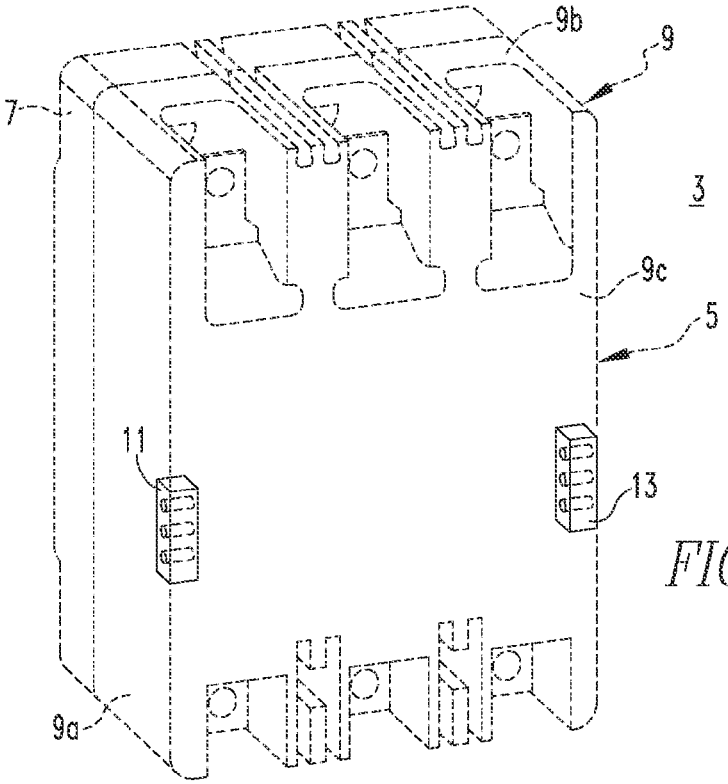
FIG. 2A is a schematic showing an assembled molded case circuit breaker and stationary connector assemblies, in accordance with certain other embodiments of the disclosed concept.

FIG. 2A shows the assembled low-voltage circuit breaker 3 as shown in FIG. 2 including the housing 5, front portion 7, rear portion 9, outer side wall 9*a*, top wall 9*b*, back wall 9*c* and, first and second stationary connector assemblies 11,13. However, in FIG. 2A, the first and second stationary connector assemblies 11,13 are each positioned in an outer side wall of the rear portion 9 (instead of in the back wall 9*c* as shown in FIG. 2). The first stationary connector assembly 11 is positioned in the outer side wall 9*a* and the second stationary connector assembly 13 is positioned in the outer side wall (not shown), opposite the side wall 9*a*. An external surface of each of the first and second stationary connector assemblies 11,13 is generally flush with the surface of each of the side walls. One or more openings (not shown) may be formed in each of the side walls to receive each of the corresponding first and second stationary connector assemblies 11,13 therein. Although FIG. 2A shows both the first and second stationary connector assemblies 11,13, it is contemplated that in certain embodiments, the low-voltage circuit breaker 3 includes only one of the two connector assemblies, e.g., only the first stationary connector assembly 11 or the second stationary connector assembly 13. Furthermore, it is contemplated that in certain embodiments, the low-voltage circuit breaker 3 includes a first stationary connector assembly positioned in the back wall 9*c* of the housing 5 (as shown in FIG. 2) and a second stationary connector assembly positioned in the side wall 9*a* of the housing 5 (as shown in FIG. 2A).

Figure 2B:
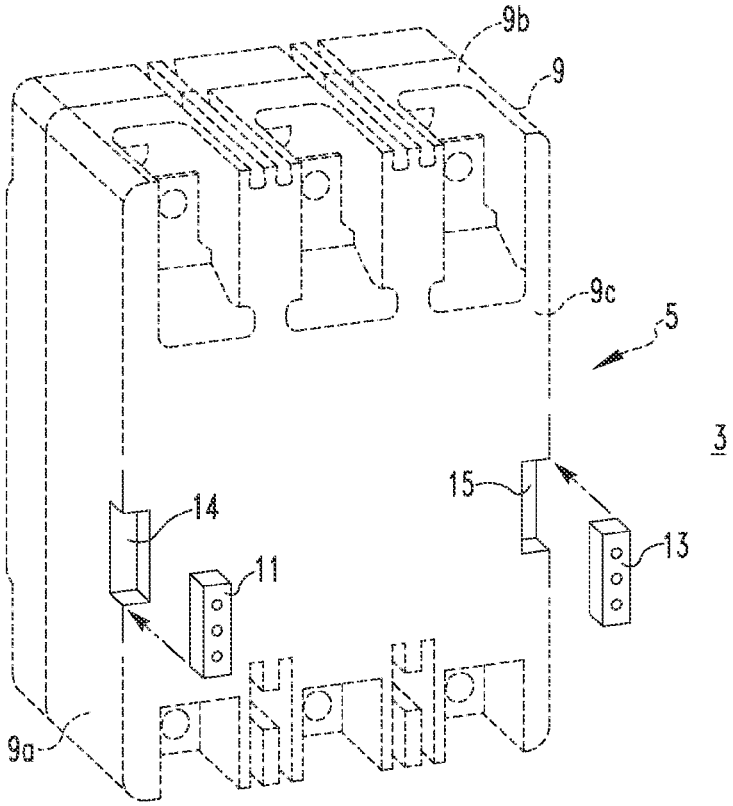
FIG. 2B is a schematic showing an assembled molded case circuit breaker and openings for insertion of the stationary connector assemblies, in accordance with certain embodiments of the disclosed concept.

FIG. 2B, shows the assembled low-voltage circuit breaker 3 as shown in FIG. 2 including the housing 5, front portion 7, rear portion 9, outer side wall 9*a*, top wall 9*b*, back wall 9*c* and, first and second stationary connector assemblies 11,13. In addition, FIG. 2B shows a first opening 14 formed in the back wall 9*c* of the rear portion 9 of the housing 5 and a second opening 15 formed opposite the first opening 14 in the back wall 9*c* of the rear portion 9 of the housing 5. Each of the first and second openings 14,15 is adapted to receive each of the corresponding first and second stationary connector assemblies 11,13.

In certain embodiments, the circuit breaker 3 has formed therein one or more slots (e.g., slots 12 as shown in FIG. 1) and the one or more slots, e.g., pre-formed slots, can provide for each of the openings 14,15 for receiving and mounting the first and second stationary connector assemblies 11,13.

Figure 3:
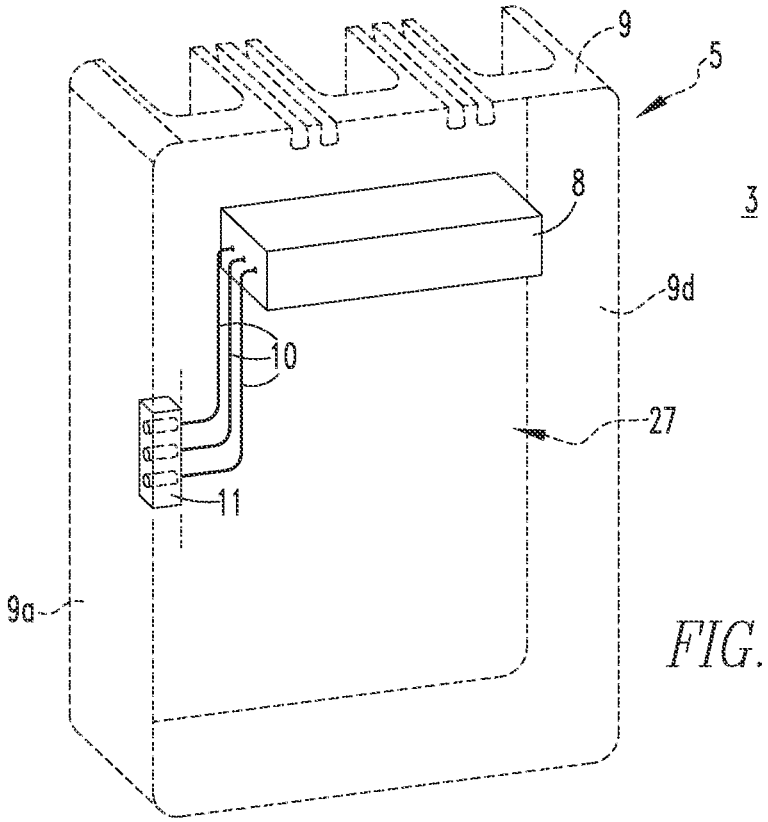
FIG. 3 is a schematic showing the back or rear portion of an unassembled molded case circuit breaker and a connector assembly for engaging accessory connection wires, in accordance with certain embodiments of the disclosed concept.

FIG. 3 shows an electrical switching apparatus such as, for example, the low-voltage circuit breaker 3 as shown in FIG. 2. However, in FIG. 2, the circuit breaker 3 is shown in an assembled view and in FIG. 3, the circuit breaker 3 is shown in an unassembled view. As previously described herein, typically (as shown in FIG. 2), the housing 5 includes a front portion 7 and a rear portion 9 which are connected together. In FIG. 3, the unassembled view includes only the open rear portion 9, e.g., molded base, having the side wall 9*a*, another side wall 9*d* positioned opposite the side wall 9*a*, and end walls, which form an internal cavity 27. Positioned within the internal cavity 27 of the housing 5 is the accessory component 8 having the plurality of accessory wires 10 extending therefrom. It is understood that there may be more than one accessory component 8 enclosed in the internal cavity 27 of the housing 5 and therefore, more than one plurality of accessory wires 10. The accessory component 8 can be selected from a variety of electrical switching apparatus accessories known in the art, such as, but not limited to, shunt trips, under-voltage releases, auxiliary contacts and bell alarm contacts. There are various other components that are typically positioned within the molded base portion of a housing for an electrical switching apparatus, which are not shown in the internal cavity 27 in FIG. 3. The first stationary connector assembly 11 is positioned within the side wall 9*a* of the rear portion 9 of the housing 5. The stationary connector assembly 11 penetrates the side wall 9*a* and extends there through to the internal cavity 27. An external surface of the first stationary connector assembly 11 is generally flush with the surface of the side wall 9*a*. Although FIG. 3 shows only one accessory component 8 and one stationary connector assembly 11, it is contemplated that another accessory component having another plurality of accessory wires may be connected to another stationary connector assembly positioned in the other side wall 9*d* opposite the side wall 9*a*.

Figure 3A:
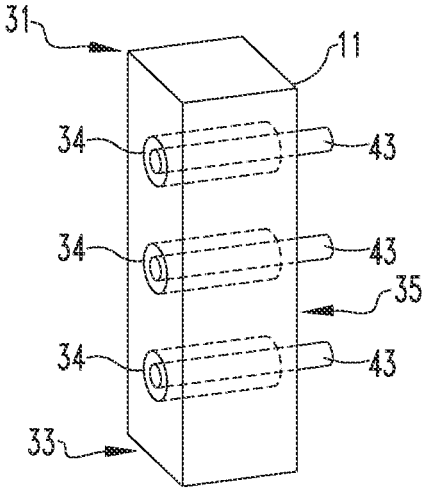
FIG. 3A is a schematic showing a detail view of the stationary connector assembly shown in FIG. 3, in accordance with certain embodiments of the disclosed concept.

FIG. 3A shows a detail of the first stationary connector assembly 11 shown in FIG. 3. As shown in FIG. 3A, the stationary connector assembly 11 includes a first end 31, an opposite second end 33, and an elongated portion 35 disposed there between. The elongated portion 35 includes a plurality of connectors 43 and corresponding connection apertures 34, which extend horizontally through the interior of the elongated portion 35. Each of the plurality of connectors 43 is adapted to engage, e.g., receive, each of the plurality of accessory wires 10, e.g., an end portion of each of the plurality of accessory wires 10 (shown in FIG. 3). As shown in FIG. 3A, there are three connection apertures 34 and three connectors 43, however, it is understood that the number of apertures and connectors can be greater or less than three.

Figure 3B:
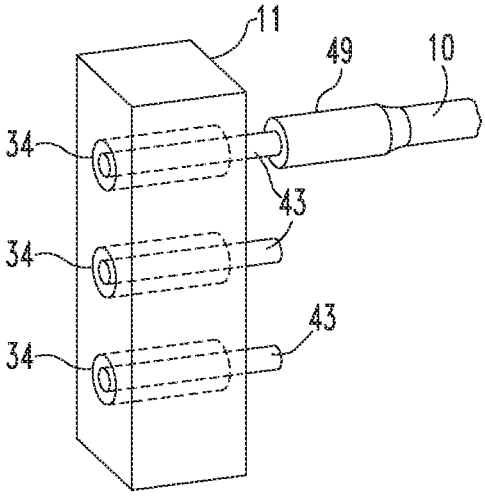
FIG. 3B is a schematic showing the stationary connector assembly of FIG. 3A and further including a fast-on connector, in accordance with certain embodiments of the disclosed concept.

FIG. 3B shows the stationary connector assembly 11 as shown in FIG. 3A including the plurality of connection apertures 34 and the plurality of connectors 43. In addition, FIG. 3B shows a slip on fast-on connector 49 which connects one of the plurality of accessory wires 10 in the housing 5 to one of the plurality of connectors 43.

Figure 4:
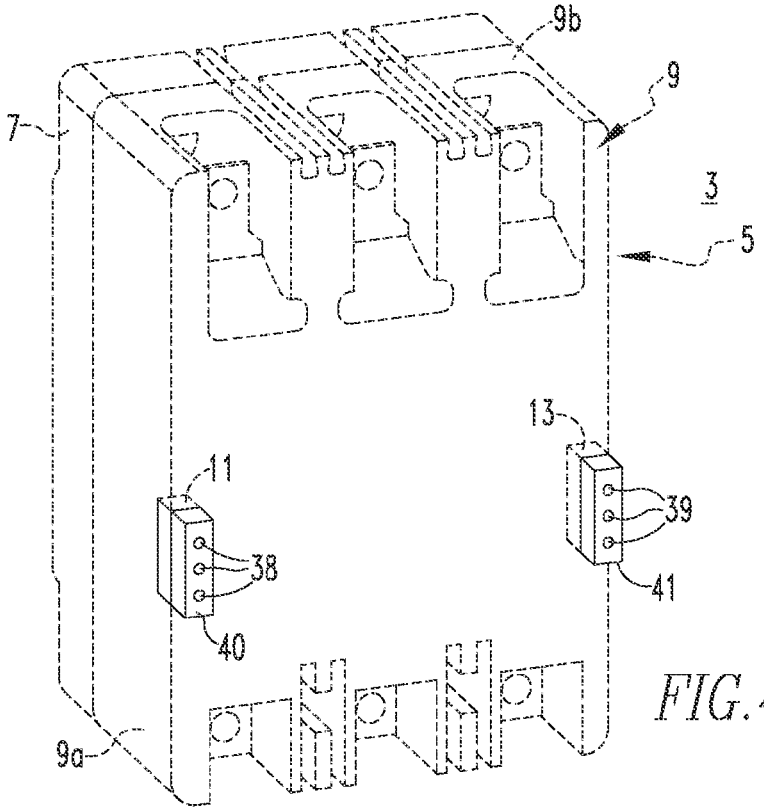
FIG. 4 is a schematic showing the assembled molded case circuit breaker and stationary connector assemblies as shown in FIG. 2 and further including plug-in mates, in accordance with certain embodiments of the disclosed concept.

FIG. 4 shows the assembled low-voltage circuit breaker 3 as shown in FIG. 2 including the housing 5, front portion 7, rear portion 9, outer side wall 9*a*, top wall 9*b*, back wall 9*c* and, first and second stationary connector assemblies 11,13. In addition, FIG. 4 includes a first plug-in mate 40, which is coupled to the first stationary connector assembly 11 and a second plug-in mate 41, which is coupled to the second stationary connector assembly 13. In FIG. 2, the external surface of each of the first and second stationary connector assemblies 11,13 is generally flush with the surface of the back wall 9*c* of the rear portion 9. Whereas, in FIG. 4, the first and second plug-in mates 40,41 are structured to connect or couple to the exterior surface of each of the corresponding first and second stationary connector assemblies 11,13 and to extend outwardly a distance beyond the surface of the back wall 9*c* and perpendicular to the surface of the back wall 9*c*. Similar to the first and second stationary connector assemblies 11,13, the first and second plug-in mates 40,41 include an elongated portion having a plurality of extension apertures 38,39, respectively, formed therein. Although FIG. 4 shows both the first and second plug-in mates 40,41, it is contemplated that in alternate embodiments one or both of the first and second plug-in mates 40,41 can be included.

Figure 4A:
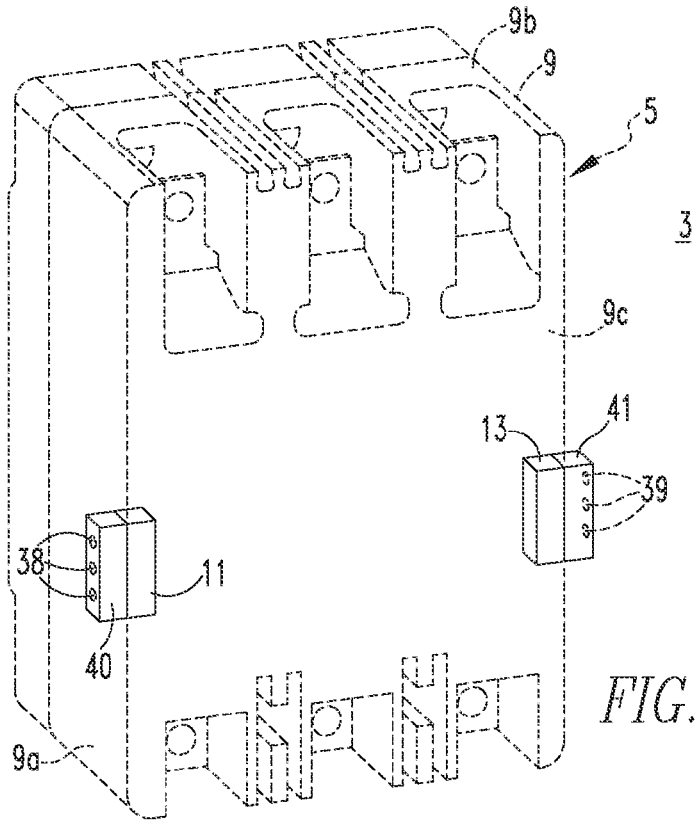
FIG. 4A is a schematic showing the assembled molded case circuit breaker and stationary connector assemblies as shown in FIG. 2 and further including plug-in mates, in accordance with certain other embodiments of the disclosed concept.

FIG. 4A shows the assembled low-voltage circuit breaker 3 as shown in FIG. 4 including the housing 5, front portion 7, rear portion 9, outer side wall 9*a*, top wall 9*b*, back wall 9*c*, first and second stationary connector assemblies 11,13, first and second plug-in mates 40,41, which are each coupled to the corresponding first and second stationary connector assemblies 11,13, and plurality of extensions apertures 38,39. Whereas, in FIG. 4, the stationary connector assemblies 11,13 are inserted into the back wall 9*c* of the rear portion 9 of the housing 5, in FIG. 4A, the stationary connector assemblies 11,13 are each inserted into the side wall 9*a* and other side wall (not shown) opposite 9*a*, of the rear portion 9 of the housing 5. The first and second plug-in mates 40,41 are structured to connect or couple to the exterior surface of each of the corresponding first and second stationary connector assemblies 11,13 and to extend outwardly a distance perpendicular and beyond the surface of the side wall 9*a* and the other side wall opposite 9*a*, respectively. Although FIG. 4A shows both the first and second plug-in mates 40,41, it is contemplated that in alternate embodiments one or both of the first and second plug-in mates 40,41 can be included.

Figure 4B:
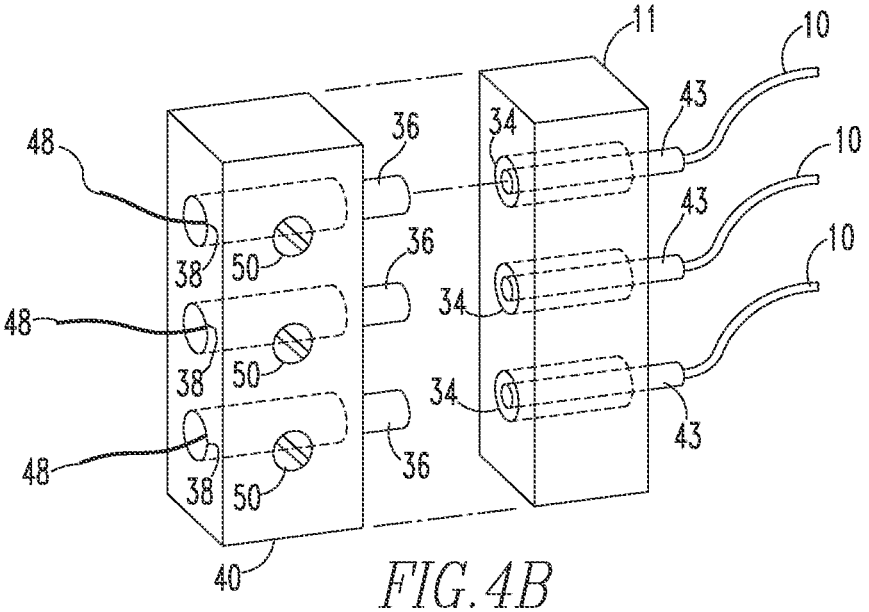
FIG. 4B is a schematic showing a detail view of one of the stationary connector assemblies and plug-in mates shown in FIG. 4, in accordance with certain embodiments of the disclosed concept.

FIG. 4B shows a detail of the first stationary connector assembly 11 and the first plug-in mate 40 as shown in FIGS. 4 and 4A. In FIG. 4B, the plurality of accessory wires 10 are connected to the plurality of connectors 43. Each of the plurality of connectors 43 is adapted to engage, e.g., receive, each of the plurality of accessory wires 10, e.g., an end portion of each of the plurality of accessory wires 10. In addition, FIG. 4B shows the first plug-in mate 40 having a plurality of mate connectors 36 and a plurality of user equipment wires 48 extending and engaging into the plurality of extension apertures 38. One end of the user equipment wires 48 are connected to any apparatus (not shown) that stimulates or uses the accessory component 8 positioned in the housing 5 (as shown in FIG. 3). The apparatus (not shown) can include alarms and programmable logic equipment. The other end of the user equipment wires 48, opposite the one end, are connected to and/or engaged with the plurality of accessory wires 10. As shown in FIG. 4B, this other end of the user equipment wires 48 are received within the plurality of extension apertures 38, which extend horizontally through the plug-in mate 40, and engage with the plurality of mate connectors 36, which are received in the connection apertures 34 of the connector assembly 11, and engage with the connectors 43, which in turn engage with the plurality of accessory wires 10. Furthermore, FIG. 4B shows a plurality of screws 50 positioned within the elongated portion of the first plug-in mate 40. The screws 50 are operable to tighten wire clamps (not shown) to secure the user equipment wires 48. The user equipment wires 48 and the accessory wires 10 are mechanically and electrically connected by inserting the plurality of mate connectors 36 into the corresponding connection apertures 34.

Figure 4C:
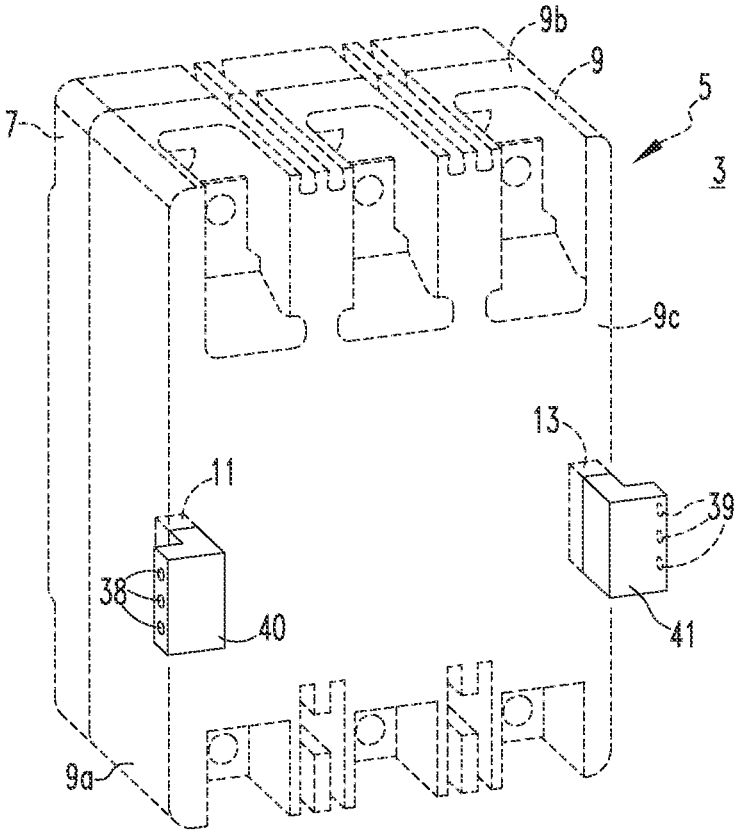
FIG. 4C is a schematic showing the assembled molded case circuit breaker and connector assemblies as shown in FIG. 2 and further including right-angle plug-in mates, in accordance with certain embodiments of the disclosed concept.

FIG. 4C shows the assembled low-voltage circuit breaker 3 as shown in FIG. 4 including the housing 5, front portion 7, rear portion 9, outer side wall 9*a*, top wall 9*b*, back wall 9*c*, first and second stationary connector assemblies 11,13, first and second plug-in mates 40,41, which are each coupled to the corresponding first and second stationary connector assemblies 11,13, and plurality of extension apertures 38,39. In FIG. 4C, the first and second plug-in mates 40,41, which are each coupled to the connector assemblies 11,13, are each a right-angle design. Although FIG. 4A shows both the first and second plug-in mates 40,41, in the shape of a right angle, it is contemplated that in alternate embodiments one or both of the first and second plug-in mates 40,41 included in the rear portion 9 of the housing 5 may be in the shape of a right angle.

In certain embodiments, the first and second plug-in mates 40,41 can be fabricated and manufactured separately from the housing 5. In these embodiments, the first and second stationary connector assemblies 11,13 and the first and second plug-in mates 40,41 can be attached in the field to the first and second stationary connector assemblies 11,13 on an as-needed basis. The material of construction for the first and second stationary connector assemblies 11,13 and the first and second plug-in mates 40,41 can be the same or different.

In other embodiments, the first and second stationary connector assemblies 11,13 and the first and second plug-in mates 40,41 may be fabricated and manufactured as a single integrated piece or part.

Existing electrical switching apparatus may be adapted to accommodate installation of the first and second stationary connector assemblies 11,13 and the first and second plug-in mates 40,41 or, alternatively, new electrical switching apparatus may be manufactured to integrate the first and second stationary connector assemblies 11,13 and/or the first and second plug-in mates 40,41 therein.

The disclosed concept also includes a method of incorporating one or more connector assemblies into an electrical switching apparatus, such as a low-voltage molded case circuit breaker, for the purpose of mechanically and electrically connecting wires from one or more accessory components, which are housed in the electrical switching apparatus, with wires from user equipment and apparatus, which are located outside of the housing of the electrical switching apparatus. As mentioned herein, the one or more connector assemblies are positioned within one or more of the walls that form the electrical switching apparatus. In certain embodiments, the one or more connector assemblies are positioned within the back wall of the electrical switching apparatus. In other embodiments, one connector assembly is positioned in each of the two side walls of the electrical switching assemblies. Since the connector assemblies are typically flush with the surface of the wall, a plug-in mate can be coupled to the each of the connector assemblies to extend the wires beyond the surface of the wall in a pre-selected direction. For example, a plug-in mate can further extend the wires outwardly in a linear or perpendicular direction. In certain embodiments, the plug-in mates are in the shape of a right-angle.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An electrical switching apparatus comprising a housing and at least one connector assembly, the housing having a front portion and a rear portion, the rear portion having a plurality of walls that form an inner cavity and an outer surface, and one or more accessory components enclosed inside of the housing, each of the one or more accessory components including at least one accessory connection wire having a first end and an opposite second end, the first end of the at least one accessory connection wire being coupled to the one or more accessory components, said at least one connector assembly comprising:

an elongated member having a first end and an opposite second end, and an elongated portion disposed there between having a face surface and a back surface;

one or more apertures formed in the elongated portion extending horizontally there through in between the face surface and the back surface; and one or more connectors correspondingly positioned within the one or more apertures, each having one end extending outwardly from the back surface of the elongated portion and adapted to correspondingly engage the second end of the at least one accessory connection wire, and each said one or more connectors having an opposite other end extending outwardly from the face surface of the elongated portion and adapted to correspondingly engage one or more wires from user equipment located outside of the housing wherein each of said one or more connectors mechanically and electrically connects each of the at least one accessory connection wire with each of the one or more user equipment wires, and wherein the at least one connector assembly is installed such that the face surface of the elongated portion is flush with the outer surface of the housing.

2. The connector assembly of claim 1, wherein the elongated member extends through one of said plurality of walls of the rear portion and the elongated member is coupled to the rear portion.

3. The connector assembly of claim 2, wherein said plurality of walls comprises a first side wall, a second side wall positioned opposite the first side wall, a first end wall, a second end wall positioned opposite the first end wall and a back wall.

4. The connector assembly of claim 3, wherein the elongated member extends through a preformed slot in one of the first side wall, the second side wall, and the back wall.

5. The connector assembly of claim 4, wherein a second elongated member extends through one of the first side wall, the second side wall, the first end wall, the second end wall and the back wall.

6. The connector assembly of claim 1, wherein the electrical switching apparatus is a molded case circuit breaker.

7. The connector assembly of claim 1, wherein the one or more accessory components is selected from the group consisting of shunt trips, under-voltage releases, auxiliary contacts and bell alarm contacts.

8. A connector assembly for an electrical switching apparatus, said electrical switching apparatus comprising a housing having a front portion and a rear portion, the rear portion having a plurality of walls that form an inner cavity and an outer surface, and one or more accessory components enclosed by the housing, each of the one or more accessory components including at least one accessory connection wire having a first end and an opposite second end, the first end of the at least one accessory connection wire being coupled to the one or more accessory components, said connector assembly comprising:

an elongated member having a first end and an opposite second end, and an elongated portion disposed there between;

one or more connectors extending outwardly from a first surface of the elongated member and adapted to engage the second end of the at least one accessory connection wire;

one or more apertures extending horizontally through the elongated member and aligning with the one or more connectors, the one or more apertures adapted to receive one or more wires from user equipment; and a plug-in mate, comprising:

an extension member having a first end and an opposite second end, and an elongated portion disposed there between;

one or more extension connectors extending outwardly from a first surface of the extension member and adapted to engage the corresponding one or more apertures of the elongated member of the connector assembly; and one or more extension apertures extending horizontally through the extension member and aligning with the one or more extension connectors, the one or more extension apertures adapted to receive the one or more wires from the user equipment.

9. The connector assembly of claim 8, wherein the plug-in mate is structured to connect to the elongated member of the connector assembly and the extension member of the plug-in mate extends outwardly perpendicular from the first surface of the elongated member.

10. The connector assembly of claim 8, wherein the plug-in mate has a right-angle shape.

11. The electrical switching apparatus of claim 1, wherein the at least one connector assembly comprises a first connector assembly and a second connector assembly, each of which extends into one of the plurality of walls.

12. The electrical switching apparatus of claim 11, wherein the first connector assembly extends into one of the plurality of walls and the second connector assembly extends into a second, different one of the plurality of walls.

* * * * *